US006417474B1

(12) United States Patent
Rakus et al.

(10) Patent No.: US 6,417,474 B1
(45) Date of Patent: Jul. 9, 2002

(54) ELECTRICAL SWITCHING APPARATUS HAVING AN ARC RUNNER WITH AN ELONGATED RAISED RIDGE

(75) Inventors: Paul Richard Rakus; Perry Robert Gibson, both of Chippewa Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/858,027

(22) Filed: May 15, 2001

(51) Int. Cl.[7] ..... H01H 33/20
(52) U.S. Cl. ..... 218/148; 218/22; 218/155
(58) Field of Search ..... 218/22, 15–21, 218/29, 34, 36, 40, 57, 148, 149, 155, 156; 335/202, 201

(56) References Cited

U.S. PATENT DOCUMENTS

| | | | | |
|---|---|---|---|---|
| 2,471,608 A | | 5/1949 | Caswell | |
| 3,238,339 A | | 3/1966 | Fehling | |
| 3,662,134 A | | 5/1972 | Cellerini | |
| 4,229,630 A | | 10/1980 | Wafer et al. | |
| 4,654,491 A | * | 3/1987 | Maier et al. | 218/154 |
| 4,713,504 A | | 12/1987 | Maier | |
| 4,871,889 A | | 10/1989 | Leone et al. | |
| 4,885,441 A | * | 12/1989 | Hisatsune et al. | 218/22 |
| 5,057,806 A | | 10/1991 | McKee et al. | |
| 5,210,385 A | * | 5/1993 | Morel et al. | 218/22 |
| 5,359,161 A | * | 10/1994 | Leach et al. | 218/22 |
| 5,969,314 A | | 10/1999 | Rakus et al. | |
| 6,005,206 A | | 12/1999 | Rakus et al. | |
| 6,100,490 A | * | 8/2000 | Turkman | 218/22 |

* cited by examiner

*Primary Examiner*—Lincoln Donovan
*Assistant Examiner*—Tuyan T. Nguyen
(74) *Attorney, Agent, or Firm*—Martin J. Moran

(57) ABSTRACT

A circuit breaker includes a load terminal and a line terminal; a pair of main contacts; a separable pair of arcing contacts; and a moving conductor assembly having a contact carrier mounted for movement between an open position and a closed position to open and close the separable pairs of contacts. The circuit breaker further includes an arc chute and an arc runner electrically connected to a stationary arcing contact and extending toward the arc chute to provide a path for an arc struck between the separable pair of arcing contacts as the separable pair of arcing contacts open with movement of the moving conductor assembly from the closed position. The arc runner has a longitudinal elongated raised ridge generally laterally centered.

16 Claims, 5 Drawing Sheets

ELECTRICAL SWITCHING APPARATUS HAVING AN ARC RUNNER WITH AN ELONGATED RAISED RIDGE

BACKGROUND OF THE INVENTION

1. Field of the Invention

This invention relates to electrical switching apparatus having an arc runner, which transfers the arc from separable contacts, such as arcing contacts, to an arc chute where the arc is extinguished.

2. Background Information

Electrical switching apparatus for power distribution systems include devices such as, for instance, circuit breakers, network protectors, transfer switches and disconnect switches. Power circuit breakers are typically used to connect a power distribution network to a power source. Such power circuit breakers must be able to withstand high currents for a period of time without tripping to give circuit breakers in the network time to respond and isolate the fault thereby localizing disruption of service. Thus, by the time the power circuit breaker responds, it may have to interrupt a sizable current. This results in the drawing of an arc as the circuit breaker contacts open. It is known to provide an arc chute adjacent to the opening path of the circuit breaker contacts. The arc chute is constructed of a number of spaced apart plates extending transverse to the arc. As the contacts open, the arc is transferred by electromagnetic forces to the arc plates, which cool the arc and increase the arc voltage by breaking it up into sections, both of which help to extinguish the arc.

It is known to employ an arc runner to drive an arc from a stationary contact to an arc chamber. See U.S. Pat. No. 4,229,630.

Typically, an arc is formed on the arcing contact and travels across a joint to the arc runner. At low currents, the electromagnetic force on the arc may not be adequate to force the arc to cross this joint. One end of the arc may remain on the stationary arcing contact, severely eroding the contact. If the arc does not move onto the arc runner it will not reach the arc chute in time for the breaker to interrupt.

U.S. Pat. No. 5,969,314 discloses an air circuit breaker with multiple movable arcing contacts, in which an arc runner is employed above an integral stationary arcing contact in order to provide a surface for the arc to run toward the center of the arc chute. This elongates the arc, divides it among the arc plates and cools the arc gases, thereby extinguishing the arc and interrupting current flow. The arcing contacts at the center of the arc chamber part last when the circuit breaker opens, causing the arc to form in the center of the arc runner. When the arc is created on the stationary arcing contact, it is more likely to travel along a sharp edge or corner of the part. A longitudinal vertical slot is disposed into the center of the arc runner in order to provide an attractive edge for the arc to travel toward the center of the arc chute. The edge of the slot encourages the arc to travel up the center of the arc runner, engaging the arc chute near the center and extinguishing the arc sooner. However, this center slot is no more attractive to the arc than the outside edges of the arc runner.

The arc may be attracted to the laterally extending edge of the stationary arcing contact instead of the slot in the arc runner. At higher voltages and lower current levels (e.g., as encountered in single-pole interruption testing for IEC certification), the arc has less electromagnetic drive to enter the arc chute and is more difficult to interrupt. The arc may run to one edge of the stationary arcing contact. This may prevent the arc from running up the arc runner. The arc may move to one side of the arc chamber and be less likely to enter the arc plates, possibly resulting in failure to interrupt.

There is a need, therefore, for electrical switching apparatus with an improved arrangement for extinguishing arcs generated during current interruption.

There is a more specific need for such an improved arrangement for directing the arc from the stationary arcing contact into an arc chute.

There is a still more specific need for such an improved arrangement for attracting the arc to the center of the arc runner and providing an improved path for the arc to follow to the center of the arc chute without stalling or wandering toward the sides of the arc chamber.

SUMMARY OF THE INVENTION

These needs and others are satisfied by the invention, which is directed to electrical switching apparatus in which a circuit breaker arc runner includes a longitudinal elongated raised ridge. The elongated raised ridge is preferably positioned directly above the location of arc formation and provides a prominence for concentrating electrical charge. This structure holds the arc in the center of the arc runner by providing the shortest path for the arc. The elongated raised ridge also provides a smooth elevated path that the arc follows up the height of the arc runner into the center of arc chute.

As one aspect of the invention, an electrical switching apparatus comprises: a load terminal and a line terminal; at least one pair of separable contacts electrically connected between the load conductor and the line conductor; an operating assembly adapted for movement between an open position and a closed position to open and close the separable contacts; an arc chute positioned adjacent the separable contacts; and an arc runner electrically connected to one of the separable contacts and extending toward the arc chute to provide a path for an arc struck between the separable contacts as the separable contacts open with movement of the operating assembly from the closed position, the arc runner having a longitudinal elongated raised ridge generally laterally centered.

The stationary arcing contact and the arc runner may comprise an electrically conductive member having a base surface in contact with the line terminal, a stationary contact surface forming the stationary arcing contact, and a runner surface leading toward the arc chute.

Preferably, the raised ridge includes a raised portion above the runner surface and a tapered portion which descends to a position proximate a surface between the stationary contact surface and the runner surface. The tapered portion may be above the stationary contact surface.

Alternatively, the raised ridge may include a raised portion above the runner surface and a tapered portion which descends to the stationary contact surface. The tapered portion may be flush with the stationary contact surface.

Alternatively, the raised ridge may include a raised portion above the runner surface and a proud portion, which protrudes above a surface between the stationary contact surface and the runner surface and above the stationary contact surface.

Alternatively, the raised ridge may include a raised portion above the runner surface and a tapered portion, which descends to a position which is offset from the stationary contact surface. The position, which is offset from the stationary contact surface, may be a position on the runner surface.

Preferably, the stationary contact is integral with the arc runner, thereby eliminating a joint therebetween.

As another aspect of the invention, an electrical switching apparatus comprises: a load conductor and a line conductor; a pair of main contacts including a movable main contact and a stationary main contact, and a separable pair of arcing contacts, including a movable arcing contact and a stationary arcing contact, the stationary main contact and the stationary arcing contact being in electrical contact with the line conductor; an operating assembly electrically connecting the movable main contact and the movable arcing contact to the load conductor, the operating assembly adapted for movement between an open position and a closed position to open and close the separable pairs of contacts, and also adapted for transitioning from closure of both the pair of main contacts and the separable pair of arcing contacts, to closure of only the separable pair of arcing contacts while the pair of main contacts are opened, to opening of the separable pair of arcing contacts in the open position thereof; an arc chute positioned adjacent the operating assembly; and an arc runner electrically connected to the stationary arcing contact and extending toward the arc chute to provide a path for an arc struck between the separable pair of arcing contacts as the separable pair of arcing contacts open with movement of the operating assembly from the closed position, the arc runner having a longitudinal elongated raised ridge generally laterally centered.

As a further aspect of the invention, an electrical switching apparatus comprises: a housing; a load conductor and a line conductor mounted in the housing; a pair of main contacts including a movable main contact and a stationary main contact, and a separable pair of arcing contacts, including a movable arcing contact and a stationary arcing contact, the stationary main contact and the stationary arcing contact being in electrical contact with the line conductor; a moving conductor assembly electrically connecting the movable main contact and the movable arcing contact to the load conductor and comprising a contact carrier mounted for movement between an open position and a closed position to open and close the separable pairs of contacts, at least one contact finger pivotally mounted on the contact carrier and having the movable arcing contact adjacent a free end and the movable main contact spaced from the free end, and contact spring means pivotally biasing the at least one contact finger to move from closure of only the pair of main contacts with the carrier in the closed position, to closure of both the pair of main contacts and the separable pair of arcing contacts, to closure of only the separable pair of arcing contacts while the pair of main contacts are opened, to opening of the separable pair of arcing contacts as the carrier moves to the open position; an arc chute positioned adjacent the moving conductor assembly; and an arc runner electrically connected to the stationary arcing contact and extending toward the arc chute to provide a path for an arc struck between the separable pair of arcing contacts as the separable pair of arcing contacts open with movement of the moving conductor assembly from the closed position, the arc runner having a longitudinal elongated raised ridge generally laterally centered.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention is applicable to electrical switching apparatus such as, for example, circuit breakers, network protectors, transfer switches and disconnect switches having separable contacts,, and will be described as applied to a power circuit breaker having main and arcing contacts.

Figure 1:
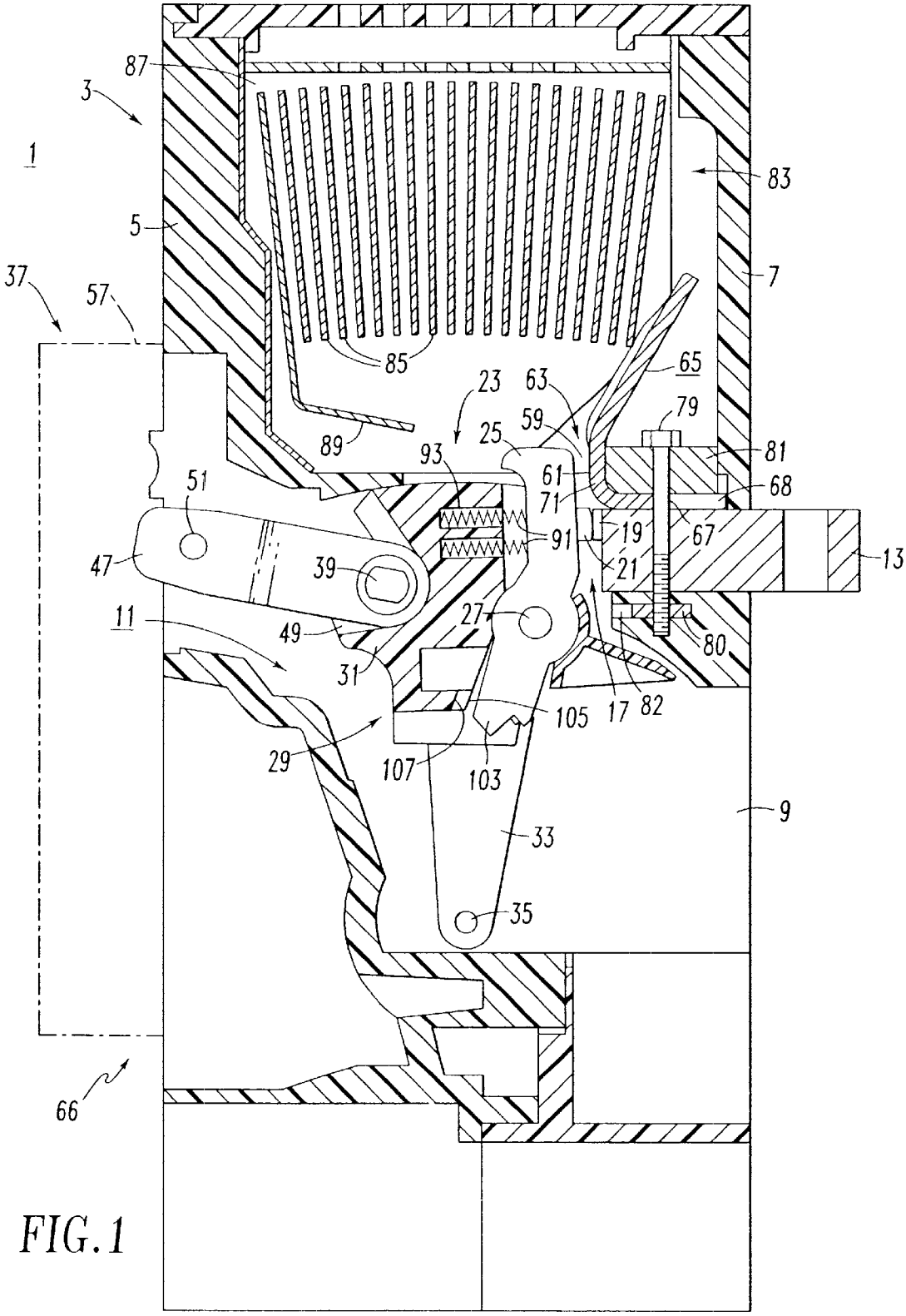
FIG. 1 is a vertical section through a circuit breaker incorporating the arc runner of the invention shown in the fully closed position.
Figure 2:
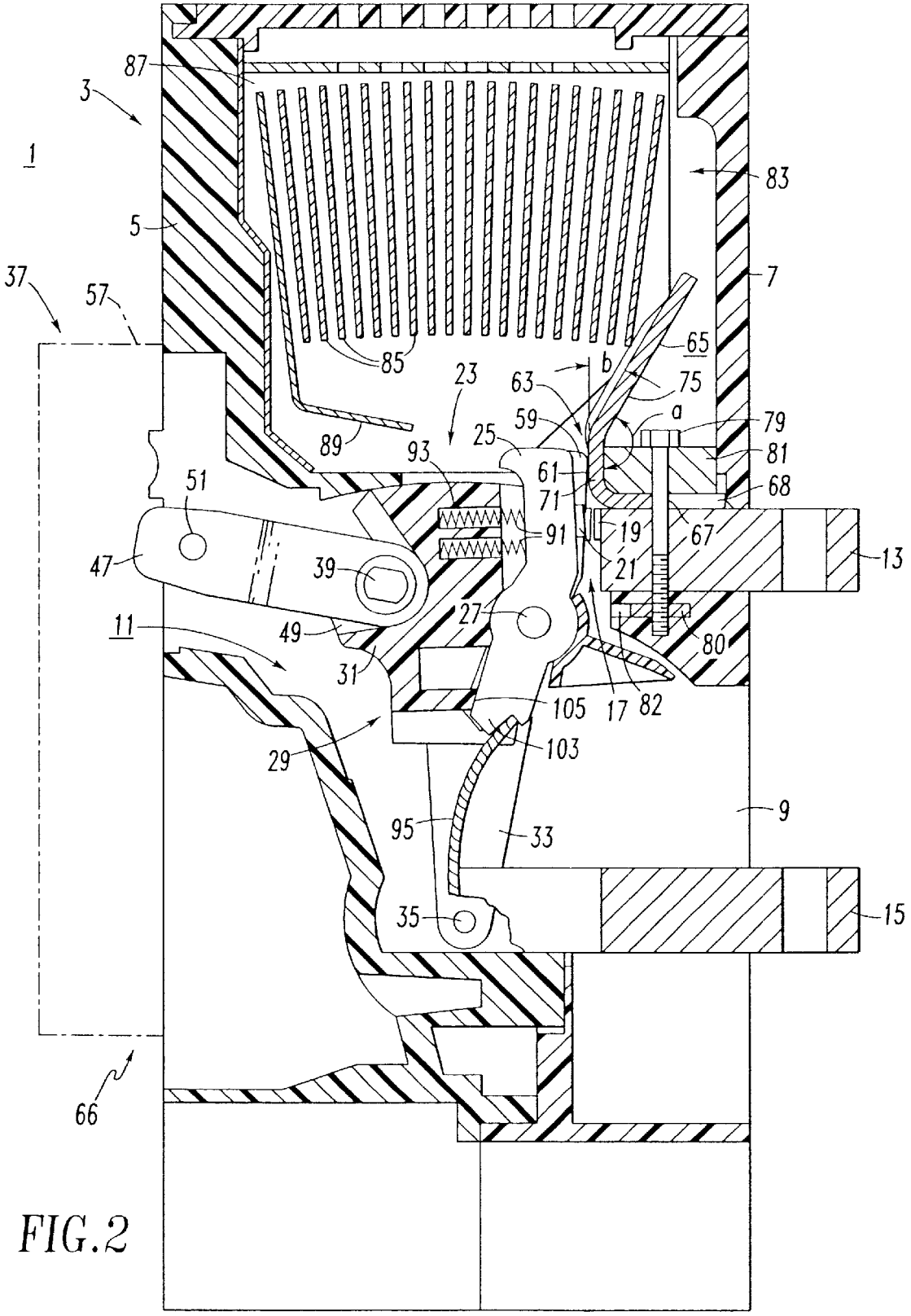
FIG. 2 is similar to FIG. 1 but showing the contact fingers about to break contact at the arcing toe.
Figure 3:
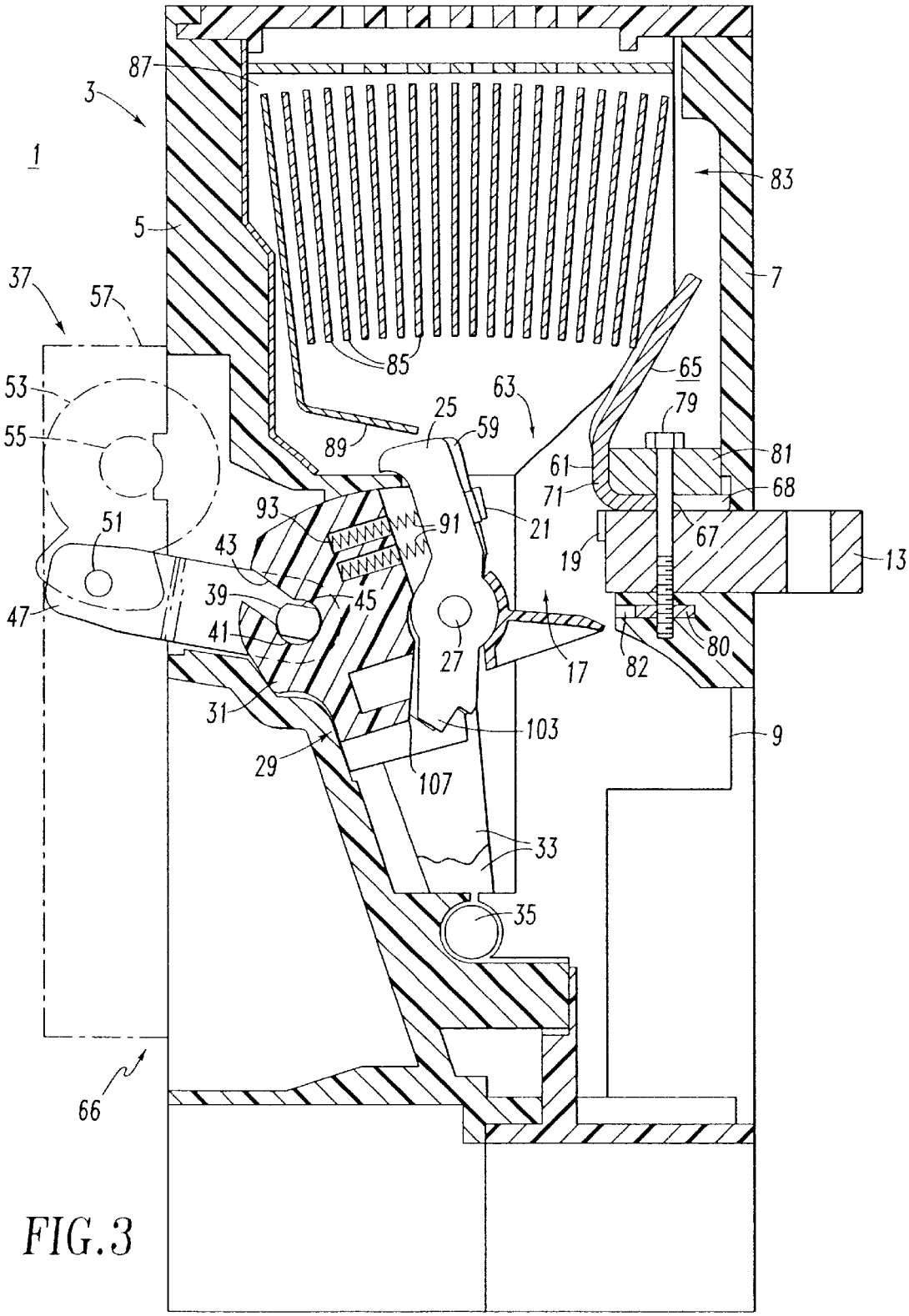
FIG. 3 is similar to FIG. 1 but showing the contact carrier in the fully open position.

FIGS. 1–3 illustrate a power air circuit breaker 1 having a housing 3 which includes a molded front casing 5 and a rear casing 7 which together define pole chambers 9 each containing a pole device 11. Typically, the circuit breaker 1 has three poles, one for each phase in a three-phase system. FIGS. 1–3 are vertical sections through one of the pole chambers 9 taken along slightly different lines to show the pertinent features.

Each pole includes a line side conductor or terminal 13 which projects out of the rear casing 7 for connection to a source of alternating current (AC) electric power (not shown). A load conductor or terminal 15 also projects out of the rear casing 7 (see FIG. 2) for connection typically to the conductors of a load network (not shown).

Each pole device 11 has a pair of main contacts 17, which include a stationary main contact 19 and movable main contact 21. The movable main contact 21 is carried by a moving conductor assembly 23. This moving conductor assembly 23 includes a plurality of contact fingers 25 which are mounted in spaced axial relation on a pivot pin 27 secured in a contact carrier 29. The contact carrier 29 has a molded body 31 and a pair of legs 33 (both legs 33 are shown in FIG. 3) having pivots 35 rotatably supported in the housing 3 (FIG. 3). In the closed position (FIG. 1), a circuit is completed from the line conductor 13 through the closed main contacts 17, the contact fingers 25, flexible shunts 95 and the load conductor 15 (see FIG. 2).

As best seen in FIG. 3, the contact carrier 29 is rotated about the pivots 35 by a drive linkage 37 which includes a drive pin 39 which is received in a transverse passage 41 in the carrier body 31 through a slot 43 to which the drive pin 39 is keyed by flats 45. The drive pin 39 is fixed on a drive link 47, which pivots in a groove 49 (FIGS. 1 and 2) in the carrier body 31. The other end of the drive link 47 pivotally connected by a pin 51 to a pole arm 53 on a pole shaft 55 similarly connected to carriers in the other poles of the circuit breaker 1. The pole shaft 55 is rotated by an operating mechanism, shown schematically at 57, mounted on the front of the front casing 5 and enclosed by a cover (not shown).

A movable main contact 21 is fixed to each of the contact fingers 25 at a point spaced from the free end of the finger. The portion of the contact finger 25 adjacent the free end forms a movable arcing contact or "arc toe". The stationary arcing contact 61 which together with the arc toe 59 forms a pair of arcing contacts 63 and is provided by the exemplary integral arcing contact and runner 65.

The moving conductor assembly 23, drive link 47 and operating mechanism 57 form an operating assembly 66 adapted for movement between an open position and a closed position to open and close the main contacts 17 and the arcing contacts 63.

Although an exemplary operating assembly 66 is disclosed for movement between an open position and a closed position to open and close the separable contacts 17,63, the invention is applicable to any suitable operating assembly for opening and closing separable contacts, such as, for example, an operating assembly which moves the exemplary contact fingers 25 to open and close separable contacts.

Figure 4:
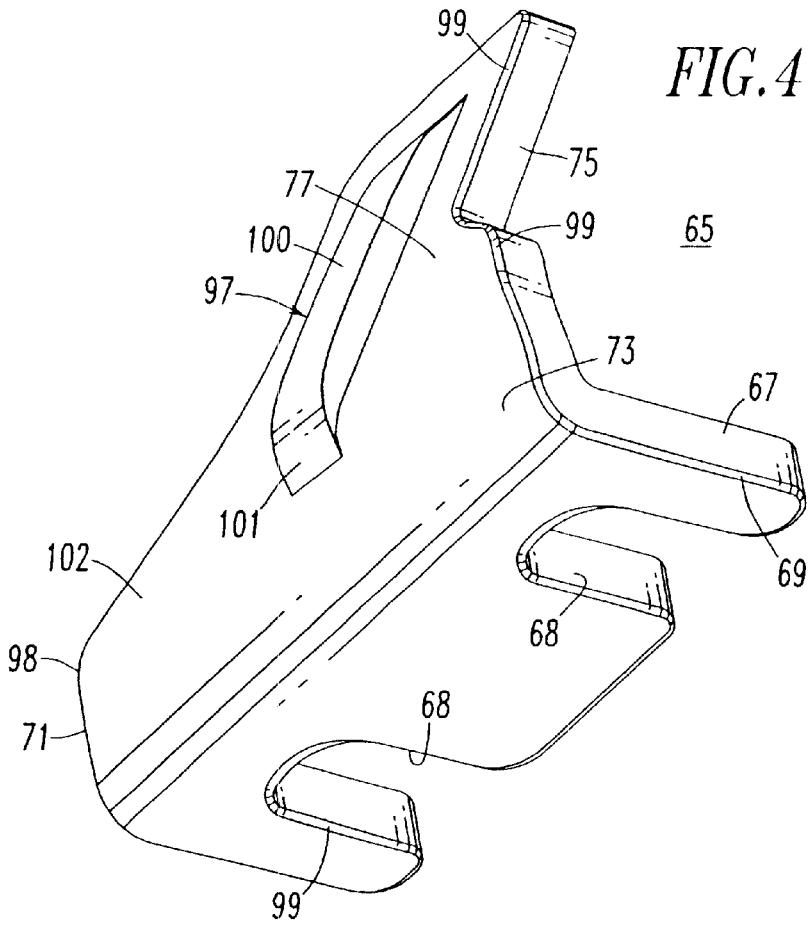
FIG. 4 is an isometric view of the arc runner of FIG. 1.

As best seen in FIG. 4, the integral arcing contact and runner 65 is an electrically conductive member having a base section 67 with a plurality of slots 68 and a base surface 69, an arcing contact section 71 having an arcing contact surface 73, and a runner section 75 having a runner surface 77. In the preferred embodiment, the integral arcing contact and runner 65 is a sheet metal member made of copper or steel plated with nickel, copper or other suitable material. The integral arcing contact and runner 65 is mounted on the line conductor 13 by a bolt 79 which extends through a support block 81, one of the slots 68 of the base section 67, the line conductor 13 and is secured by a nut 80 seated in a slot 82 in the housing 3, as shown for instance in FIG. 2.

Although an exemplary support block 81 is shown, that support block may be replaced by a suitable projection from the rear casing 7. Alternatively, a self-supporting integral arcing contact and runner may be employed without a support block. In additional, further support may be provided by the rear casing 7. Although slots 68 are shown in the exemplary runner 65, a wide range of one or more other openings (e.g., holes) for fasteners may be employed. As another alternative, the integral arcing contact and runner 65 need not be bolted by the bolt 79 and nut 80 and, instead, may be suitably welded, brazed, riveted, and/or fastened by any suitable mechanical fastener.

The arcing contact surface 73 of the integral arcing contact and runner 65 is parallel to the stationary main contact 19 but extends laterally farther toward the movable arcing contact or arc toe 59 for a purpose to be discussed. The runner section 75 forms an obtuse angle a (FIG. 2) with the arcing contact section 71 and leads upward and outward toward one side of an arc chute 83, which is positioned adjacent the arcing contacts 63. Thus, the sheet metal member 65 is bent by an angle β (FIG. 2) of less than 90° in forming the arcing contact section 71 and the runner section 75. Arc chutes such as 83 are known and include a plurality of arc plates 85 held in spaced relation by a pair of arc side plates 87 (only one is shown). At the other side of the arc chute 83 is a top arc plate 89 which extends downward and points toward the movable arcing contact 59, again for a purpose to be described.

Although an exemplary angle β is shown, the invention is applicable to larger or smaller angles (e.g., about 0 degrees or less, in which the arc chute is not as wide as the width of the arc chute 83 and fewer arc plates 85 are employed).

The contact fingers 25 are biased clockwise (with respect to FIGS. 1–3) by pairs of helical compression springs 91 seated in recesses 93 in the carrier body 31. Operation of the operating mechanism 57, pole shaft 55, moving conductor assembly 23 and contact carrier 29 in order to open and close the contacts 17,63 is described in U.S. Pat. No. 5,969,314, which is incorporated by reference herein.

If current is being carried by the circuit breaker 1, such as when the circuit breaker trips open in response to an overcurrent or short circuit, the electromagnetic forces produced by the current sustained in the arc push the arc outward toward the arc chute 83 in order that the end of the arc at the stationary arcing contact 61 moves up the arcing contact section 71 of the integral arcing contact and runner 65 onto the runner section 75. At the same time, the rapid opening of the contact carrier 29 brings the arc toes 59 adjacent the free end of the arc top plate 89 as shown in FIG. 3 so that the arc extends from the arc toe 59 to that arc top plate, and moves up such arc top plate into the arc plates 85 which breaks the arc up into shorter sections. As is known, this stretching of the arc and breaking it up into smaller sections increases the arc voltage. The increase in arc voltage, together with the cooling of the arc by ablation of the arc plates 85, promotes interruption of the arc.

The contact carrier 29 has a feature (recess 107 of FIG. 1), which concentrates the arc near the center of the stationary arcing contact 61, and, therefore, helps to direct the arc toward the longitudinal elongated raised ridge 97 of FIG. 4 In turn, the elongated raised ridge 97 directs the arc upward toward the arc chute 83. The ridge 97 is preferably positioned directly above the location of arc formation and concentrates electrical charge. The ridge 97 holds the arc in the center of the integral arcing contact and runner 65 by providing the shortest path for the arc. The ridge 97 also provides a smooth elevated path that the arc follows up the height of the integral arcing contact and runner 65 into the center of arc chute 83.

The preferred design smoothes any corners on the outside profile of the integral arcing contact and runner 65 and rounds-off the leading comer of the outside edges, such as shown at 99 of FIG. 4, in order to avoid any feature that is attractive to the arc.

The elongated raised ridge 97 in the center of the integral arcing contact and runner 65 is preferably provided by forming the material upward (i.e., toward the left of FIGS. 1–3 and 5) with a "semi-pierce" in the tooling that stamps the arc runner part. Also, the rounded leading comer of arc runner edges 99 are preferably provided by increasing the typical "die-roll" in the tool or by forming the material backward with a form tool.

Figure 5:
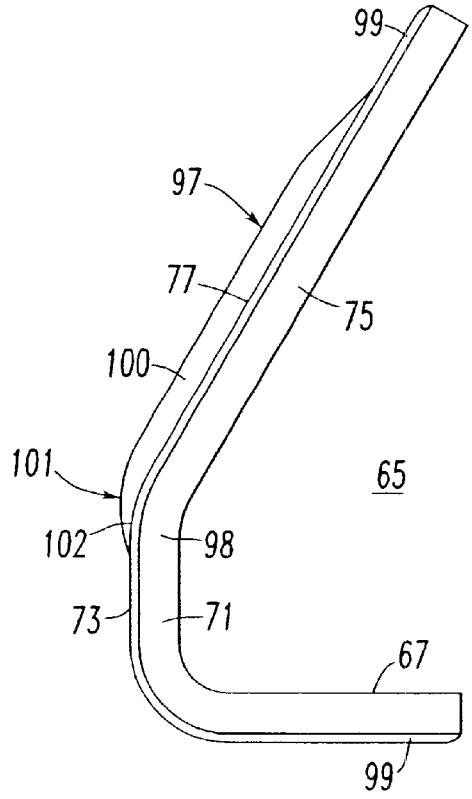
FIG. 5 is a side view of the arc runner of FIG. 4.

As best shown in FIG. 5, the elongated raised ridge 97 includes a raised portion 100 above the runner surface 77 and a tapered portion 101, which descends to a position proximate an arcuate surface 102 between the stationary contact surface 73 and the runner surface 77.

Figure 6:
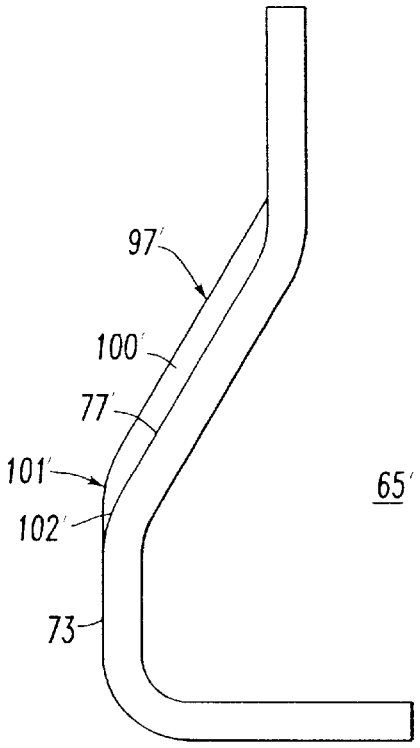
FIGS. 6–8 are views similar to FIG. 5, but show arc runners in accordance with alternative embodiments of the invention.
Figure 7:
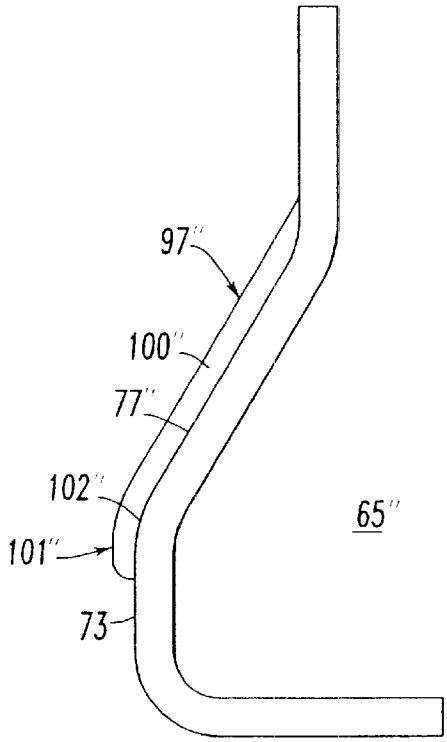
Figure 8:
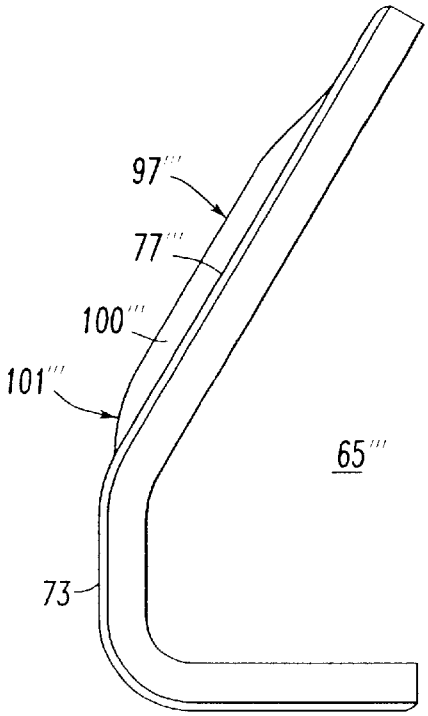

FIGS. 6–8 are views similar to FIG. 5, but of respective arc runners 65', 65" and 65'" in accordance with alternative embodiments of the invention. As shown in FIG. 6, the raised ridge 97' includes a raised portion 100' above a runner surface 77' and a tapered portion 101' which descends to the stationary contact surface 73. Preferably, the tapered portion 101' is flush with the stationary contact surface 73.

As shown in FIG. 7, the elongated raised ridge 97'" includes a raised portion 100" above the runner surface 77" and a proud portion 101", which protrudes above the surface 102" and above the stationary contact surface 73.

As shown in FIG. 8, the raised ridge 97'" includes a raised portion 100'" above the runner surface 77'" and a tapered portion 101'", which descends to a position on the runner surface 77'", which position is offset from the stationary contact surface 73.

Preferably, the stationary arcing contact 61 and the runner section 75 are integral thereby eliminating the joint between these two elements. This provides a single smooth surface from the point of arc creation to the top of the integral arcing contact and runner 65. The result is an increase in the speed of movement of the arc up the integral arcing contact and runner 65 and into the arc chute 83, even at low current levels. Also, there is no top edge on the arcing contact 61, which might lead the arc to one side of the arc chute 83.

The exemplary integral arcing contact and runner 65 also has an arcuate section 98 between the arcing contact section 71 and the runner section 75 which provides the arcuate surface 102 without any sharp lateral edges which could, otherwise, divert the arc to the sides or cause hesitation in movement of the arc toward the arc chute 83.

As can be seen from FIG. 2, the tail ends 103 of the contact fingers 25 are biased by the springs 91 against a stop ledge 105 on the carrier body 31. The center of this stop ledge 105 has a recess 107 (see FIG. 1) which allows the center contact fingers 25 to rotate farther clockwise than the outer contact fingers (see FIG. 3) when the contact carrier 29 is not in the closed position. Therefore, the arcing contacts 59 on the center contact fingers 25 are the first to contact during closing. More importantly, they are the last to separate on opening so that the arc is struck primarily between the arcing contacts at the center.

The exemplary integral arcing contact and runner 65 and the elongated raised ridge 97 improve arc interruption performance of the circuit breaker 1 at higher voltage ratings than were possible with circuit breakers with prior known arc runners. The exemplary elongated raised ridge 97 provides a smooth elevated path that the arc follows up the height of the integral arcing contact and runner 65 into the center of the arc chute 83. This elongated raised ridge attracts and centers the arc, rather than the outside edges of the arc runner. Otherwise, the arc might hesitate before entering the arc chute.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breath of the claims appended and any and all equivalents thereof.

What is claimed is:

1. An electrical switching apparatus comprising:

a load terminal and a line terminal;

at least one pair of separable contacts electrically connected between said load terminal and said line terminal;

an operating assembly adapted for movement between an open position and a closed position to open and close said separable contacts;

an arc chute positioned adjacent said separable contacts; and an arc runner electrically connected to one of said separable contacts and extending toward said arc chute to provide a path for an arc struck between said separable contacts as said separable contacts open with movement of said operating assembly from the closed position, said arc runner having a longitudinal elongated raised ridge generally laterally centered;

wherein said separable contacts include a stationary contact and a moving contact;

wherein said stationary contact and said arc runner comprise an electrically conductive member having a base surface in contact with said line terminal a stationary contact surface forming said stationary contact, and a runner surface leading toward said arc chute;

wherein said raised ridge includes a raised portion above said runner surface and a tapered portion which descends to a position proximate a surface between; said stationary contact surface and said ranger surface; and wherein said tapered portion is above said stationary contact surface.

2. An electrical switching apparatus comprising:

a load terminal and a line terminal;

at least one pair of separable contacts electrically connected between said load terminal and said line terminal;

an operating assembly adapted for movement between an open position and a closed position to open and close said separable contacts;

an arc chute positioned adjacent said separable contacts; and an arc runner electrically connected to one of said separable contacts and extending toward said arc chute to provide a path for an arc struck between said separable contacts as said separable contacts open with movement of said operating assembly from the closed position, said arc Inner having a longitudinal elongated raised ridge generally laterally centered;

wherein said separable contacts include a stationary contact and a moving contact;

wherein said stationary contact and said arc runner comprise an electrically conductive member having a base surface in contact with said line terminal, a stationary contact surface forming said stationary contact, and a runner surface leading toward said arc chute; and wherein said raised ridge includes a raised portion above said runner surface and a tapered portion which descends to said stationary contact surface.

3. The electrical switching apparatus of claim 2 wherein said tapered portion is flush with said stationary contact surface.

4. An electrical switching apparatus comprising:

a load terminal and a line terminal;

at least one pair of separable contacts electrically connected between said load terminal and said line terminal;

an operating assembly adapted for movement between an open position and a closed position to open and close said separable contacts;

an arc chute positioned adjacent said separable contacts; and an arc runner electrically connected to one of said separable contacts and extending toward said art chute to provide a path for an arc struck between said separable contacts as said separable contacts open with movement of said operating assembly from the closed position, said arc runner having a longitudinal elongated raised ridge generally laterally centered;

wherein said separable contacts include a stationary contact and a moving contact;

wherein said stationary contact and said arc runner comprise an electrically conductive member having a base surface in contact with said line terminal, a stationary contact surface forming said stationary contact, and a runner surface leading toward said arc chute; and wherein said raised ridge includes a raised portion above said runner surface and a proud portion, which protrudes above a surface between said stationary contact surface and said runner surface and above said statioary contact surface.

5. The electrical switching apparatus of claim 1 wherein said stationary contact is integral with said arc runner, thereby eliminating a joint therebetween.

6. An electrical switching apparatus comprising:

a load conductor and a line conductor;

a pair of main contacts including a movable main contact and a stationary main contact, and a separable pair of arcing contacts, including a movable arcing contact and a stationary arcing contact, said stationary main contact and said stationary arcing contact being in electrical contact with said line conductor;

an operating assembly electrically connecting said movable main contact and said movable arcing contact to said line conductor, said operating assembly adapted for movement between an open position and a closed position to open and close said separable pairs of contacts, and also adapted for transitioning from closure of both said pair of main contacts and said separable pair of arcing contacts, to closure of only said separable pair of arcing contacts while said pair of main contacts are opened, to opening of said separable pair of arcing contacts in said open position thereof;

an arc chute positioned adjacent said operating assembly; and an arc runner electrically connected to said stationary arcing contact and extending toward said arc chute to provide a path for an arc struck between said separable pair of arcing contacts as said separable pair of arcing contacts open with movement of said operating assembly from the closed position, said arc runner having a longitudinal elongated raised ridge generally laterally centered;

wherein said stationary arcing contact and said arc runner comprise an electrically conductive member having a base surface in contact with said line conductor, a stationary contact surface forming said stationary arcing contact, and a runner surface leading toward said arc chute; and wherein said raised ridge includes a raised portion above said runner surface and a tapered portion which descends to a position proximate a surface between said stationary contact surface and said runner surface, with said tapered portion being above said stationary contact surface.

7. The electrical switching apparatus of claim 6 wherein said operating assembly includes at least one contact finger pivotally mounted on a contact carrier and having said movable arcing contact adjacent a free end and said movable main contact spaced from said free end, and further includes contact spring means pivotally biasing said at least one contact finger.

8. An electrical switching apparatus comprising:

a load conductor and a line conductor;

a pair of main contacts including a movable main contact and a stationary main contact, and a separable pair of arcing contacts, including a movable arcing contact and a stationary arcing contact, said stationary main contact and said stationary arcing contact being in electrical contact with said line conductor;

an operating assembly electrically connecting said movable main contact and said movable arcing contact to said line conductor, said operating assembly adapted for movement between an open position and a closed position to open and close said separable pairs of contacts, and also adapted for transitioning from closure of both said pair of main contacts and said separable pair of arcing contacts, to closure of only said separable pair of arcing contacts while said pair of main contacts are opened, to opening of said separable pair of arcing contacts in said open position thereof;

an arc chute positioned adjacent said operating assembly; and an arc runner electrically connected to said stationary arcing contact and extending toward said arc chute to provide a path for an arc struck between said separable pair of arcing contacts as said separable pair of arcing contacts open with movement of said operating assembly from the closed position, said arc runner having a longitudinal elongated raised ridge generally laterally centered;

wherein said stationary arcing contact and said arc runner comprise an electrically conductive member having a base surface in contact with said line conductor, a stationary contact surface forming said stationary arcing contact, and a manner surface leading toward said arc chute; and wherein said raised ridge includes a raised portion above said runner surface and a tapered portion which descends to said stationary contact surface, with said tapered portion being lush with said stationary contact surface.

9. An electrical switching apparatus comprising:

housing;

a load conductor and a line conductor mounted in said housing;

a pair of main contacts including a movable main contact and a stationary main contact, and a separable pair of arcing contacts, including a movable arcing contact and a stationary arcing contact, said stationary main contact and said stationary arcing contact being in electrical contact with said line conductor;

a moving conductor assembly electrically connecting said movable main contact and said movable arcing contact to said line conductor and comprising a contact carrier mounted for movement between an open position and a closed position to open and close said separable pairs of contacts, at least one contact finger pivotally mounted on said contact carrier and having said movable arcing contact adjacent a free end and said movable main contact spaced from said free end, and contact spring means pivotally biasing said at least one contact finger to move from closure of only said pair of main contacts with said carrier in said closed position, to closure of both said pair of main contacts and said separable pair of arcing contacts, to closure of only said separable pair of arcing contacts while said pair of main contacts are opened, to opening of said separable pair of arcing contacts as said carrier moves to said open position;

an arc chute positioned adjacent said moving conductor assembly; and an arc runner electrically connected to said stationary arcing contact and extending toward said arc chute to provide a path for an arc struck between said separable pair of arcing contacts as said separable pair of arcing contacts open with movement of said moving conductor assembly from the closed position, said arc runner having a longitudinal elongated raised ridge generally laterally centered;

wherein said raised ridge includes a raised portion above said arc runner and a proud portion, which protrudes above a surface between said stationary arcing contact and said arc runner and above said stationary arcing contact.

10. The electrical switching apparatus of claim 9 wherein said stationary arcing contact and said arc runner comprise an electrically conductive member having a base surface in contact with said line conductor, a stationary arcing contact surface forming said stationary arcing contact, and a runner surface leading toward said arc chute.

11. The electrical switching apparatus of claim 10 wherein said arcing contact surface of said electrically conductive member is substantially transverse to said base surface and at an obtuse angle to said runner surface.

12. The electrical switching apparatus of claim 10 wherein said electrically conductive member is a sheet metal member having a base section with said base surface, a stationary arcing contact section with said stationary arcing contact surface, and a runner section with said runner surface.

13. The electrical switching apparatus of claim 12 wherein said arcing contact surface of said electrically conductive member is substantially transverse to said base surface and at an obtuse angle to said runner surface.

14. The electrical switching apparatus of claim 13 including a support member between said arcing contact section and said housing, and fastener means extending through said support member, said base section, and said line conductor and secured to said housing.

15. The electrical switching apparatus of claim 12 wherein said sheet metal member includes an arcuate section with an arcuate surface between said arcing contact section and said runner section.

16. The electrical switching apparatus of claim 15 wherein said movable arcing contact comprises an arc toe on said at least one contact finger.

* * * * *